US007469602B2

(12) United States Patent
Gharib et al.

(10) Patent No.: US 7,469,602 B2
(45) Date of Patent: Dec. 30, 2008

(54) ELECTRONIC TORQUE WRENCH WITH A ROTATABLE INDEXABLE DISPLAY DEVICE

(75) Inventors: Awad Aly Gharib, Cockeysville, MD (US); Steve Booher, Woodstock, GA (US); Bruce Dexter, South Windsor, CT (US)

(73) Assignee: Easco Hand Tools, Inc., Simsbury, CT (US)

( * ) Notice: Subject to any disclaimer, the term of this patent is extended or adjusted under 35 U.S.C. 154(b) by 0 days.

(21) Appl. No.: 12/053,710

(22) Filed: Mar. 24, 2008

(65) Prior Publication Data

US 2008/0168871 A1 Jul. 17, 2008

Related U.S. Application Data

(63) Continuation of application No. 11/487,251, filed on Jul. 14, 2006, now Pat. No. 7,370,539.

(60) Provisional application No. 60/700,130, filed on Jul. 18, 2005.

(51) Int. Cl.
*B25B 23/14* (2006.01)

(52) U.S. Cl. ..... 73/862.21; 73/862.08; 73/862.23; 73/862.26

(58) Field of Classification Search ..... 73/862.08, 73/862.21, 862.26; 81/479, 483
See application file for complete search history.

(56) References Cited

U.S. PATENT DOCUMENTS

| | | | |
|---|---|---|---|
| 4,257,263 | A | 3/1981 | Herrgen |
| 4,397,196 | A | 8/1983 | Lemelson |
| 4,558,601 | A | 12/1985 | Stasiek et al. |
| 4,641,538 | A | 2/1987 | Heyraud |
| 4,643,030 | A | 2/1987 | Becker et al. |
| 5,315,501 | A | 5/1994 | Whitehouse |
| 5,537,877 | A | 7/1996 | Hsu |
| 5,589,644 | A | 12/1996 | Becker et al. |
| 6,070,506 | A | 6/2000 | Becker |
| 6,076,439 | A | 6/2000 | Dzieman |
| 6,119,562 | A | 9/2000 | Jenkins |
| 6,155,147 | A | 12/2000 | Dzieman |
| 6,167,788 | B1 | 1/2001 | Schonberger et al. |
| 6,276,243 | B1 | 8/2001 | Jenkins |
| 6,345,436 | B1 | 2/2002 | Codrington |

(Continued)

*Primary Examiner*—Edward Lefkowitz
*Assistant Examiner*—Freddie Kirkland, III
(74) *Attorney, Agent, or Firm*—Nelson Mullins Riley & Scarborough, LLP

(57) ABSTRACT

A torque wrench for engaging a workpiece includes a wrench body having a first end and a second end. A wrench head is disposed on the first end of the wrench body and is configured to engage the workpiece. A display device is carried by the wrench body and includes a housing, a display, and an input device for inputting a preset torque value. A torque sensor is carried by the wrench head and is electrically connected to the display device. A detent extends outwardly from one of the wrench body, the wrench head, and the user interface and a plurality of recesses is formed in another of the wrench body, the wrench head, and the user interface, each of the recesses being configured to releasably receive the detent. The display device is rotatable relative to the wrench head so that the detent is received by one of the recesses for retaining the display device in a desired angular position with regard to the wrench head.

15 Claims, 7 Drawing Sheets

U.S. PATENT DOCUMENTS

| | | | | |
|---|---|---|---|---|
| D458,817 | S | 6/2002 | Jenkins | |
| 6,526,853 | B2 | 3/2003 | Jenkins | |
| 6,698,298 | B2 | 3/2004 | Tsuji et al. | |
| 6,968,759 | B2 | 11/2005 | Becker et al. | |
| 6,981,436 | B2 | 1/2006 | Becker et al. | |
| 7,000,508 | B2 | 2/2006 | Li et al. | |
| 7,047,849 | B2 | 5/2006 | Lai | |
| 7,082,865 | B2 | 8/2006 | Reynertson, Jr. | |
| 7,082,866 | B2 | 8/2006 | Becker | |
| 7,089,834 | B2 | 8/2006 | Reynertson et al. | |
| 7,107,884 | B2 | 9/2006 | Cutler et al. | |
| 7,168,349 | B1 | 1/2007 | Hsieh | |
| 7,168,350 | B1 | 1/2007 | Hsieh | |
| 7,174,817 | B1 | 2/2007 | Hsieh | |
| 7,182,005 | B1 | 2/2007 | Hsieh | |
| 7,185,571 | B1 | 3/2007 | Hsieh | |
| 7,222,544 | B1 | 5/2007 | Jenkins | |
| 7,370,539 | B2 * | 5/2008 | Gharib et al. | 73/862.21 |
| 2002/0170395 | A1 | 11/2002 | Wang et al. | |
| 2002/0178876 | A1 | 12/2002 | Wang et al. | |
| 2005/0092143 | A1 | 5/2005 | Lehnert et al. | |
| 2005/0223856 | A1 | 10/2005 | Reynertson et al. | |
| 2007/0119267 | A1 | 5/2007 | Anjanappa et al. | |
| 2007/0119268 | A1 | 5/2007 | Escoe et al. | |
| 2007/0119269 | A1 | 5/2007 | Anjanappa et al. | |

* cited by examiner

ELECTRONIC TORQUE WRENCH WITH A ROTATABLE INDEXABLE DISPLAY DEVICE

CLAIM OF PRIORITY

This application is a continuation of U.S. patent application Ser. No. 11/487,251, filed Jul. 14, 2006, which claims priority to U.S. Provisional Application 60/700,130 filed Jul. 18, 2005, the entire disclosures of which are incorporated by reference herein.

FIELD OF THE INVENTION

The present invention relates generally to torque application and measurement devices. More particularly, the present invention relates to a display device for an electronic torque wrench.

BACKGROUND OF THE INVENTION

Often, fasteners used to assemble performance critical components are tightened to a specified torque level to introduce a "pretension" in the fastener. As torque is applied to the head of the fastener, beyond a certain level of torque the fastener begins to stretch. This stretch results in the pretension in the fastener which then holds the components together. A popular method of tightening these fasteners is to use a torque wrench. Accurate and reliable torque wrenches help insure the fasteners are tightened to the proper torque specifications.

Torque wrenches vary from simple mechanical types to sophisticated electronic types. Mechanical type torque wrenches are generally less expensive than electronic ones. There are two common types of mechanical torque wrenches, beam and clicker types. With a beam type torque wrench, a beam bends relative to a non-deflecting beam in response to the torque being applied with the wrench. The amount of deflection of the bending beam relative to the non-deflecting beam indicates the amount of torque applied to the fastener. Clicker type torque wrenches work by preloading a snap mechanism with a spring to release at a specified torque, thereby generating a click noise.

Electronic torque wrenches (ETWs) tend to be more expensive than mechanical torque wrenches, and more accurate as well. When applying torque to a fastener with an electronic torque wrench, the torque readings indicated on the display device of the electronic torque wrench are proportional to the pretension in the fastener due to the applied torque. However, the readings also depend on, among other factors, the under head friction between the head of the fastener and the adjacent surface of the component and the friction between the mating threads. Static friction is greater than dynamic friction. Therefore, when torquing operations are initiated, increased amounts of torque may be required to overcome static friction forces and initiate rotation of the fastener. Therefore, it follows that torque is preferably applied to the fastener in a slow and continuous manner to allow friction forces to stabilize, to help insure accuracy and to help prevent over-torquing.

Existing electronic torque wrenches typically have an electronic interface unit that includes a digital torque display, alarm signals, and operating switches, the unit being rotationally fixed with respect to the wrench body. These electronic interface units of fixed orientation are suited for tightening fasteners whose axes are vertical since the user can view the electronic interface unit. However, often these units are not convenient when the user has to tighten fasteners whose axes cause the wrench to be situated such that the electronic interface unit is not readily visible. Although the sound alarm, if present, can be heard in most cases, it is only one of several indicators that the user can utilize to prepare to stop applying torque at the proper time, so as not to over-torque the fastener. When applying torque, the user may use the numerical display to adjust the speed of rotation of the wrench so that he is prepared to stop as soon as he hears an alarm sound and/or sees a light signal. Without the continuous numerical display feedback available, and using only the alarm signals, the probability of over-torquing may increase. In summary, not only is it difficult to apply torque to a fastener while trying to simultaneously view a display at an odd angle, it may also increase the chances of over or under-torquing the fasteners.

Drawbacks present in prior art electronic torque wrenches may lead to the over or under-torquing of fasteners, which can contribute to reduced performance, and eventual failure, of the fasteners.

The present invention recognizes and addresses the foregoing considerations, and others, of prior art constructions and methods.

SUMMARY OF THE INVENTION

One embodiment of the present invention provides an electronic torque wrench for engaging a workpiece, the wrench including a wrench body having a first end and a second end. A wrench head is disposed on the first end of the wrench body and the wrench is head configured to engage the workpiece. A grip handle is disposed on the second end of the wrench head and a user interface is carried by the wrench body. The user interface includes a housing, a digital display, and an input device for inputting a preset torque value. A torque sensing element is carried by the wrench head and there is an electrical connection between the torque sensing element and the display device. A detent extends outwardly from one of the wrench body, the wrench head, and the user interface. A plurality of recesses is formed in another of the wrench body, the wrench head, and the user interface, each of the recesses being configured to releasably receive the detent. The display device is rotatable relative to the wrench head about a longitudinal center axis of the wrench body so that the detent is received by one of the recesses for retaining the display device in a desired angular position with regard to the wrench head.

The accompanying drawings, which are incorporated in and constitute a part of this specification, illustrate one or more embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended drawings, in which.

Figure 1:
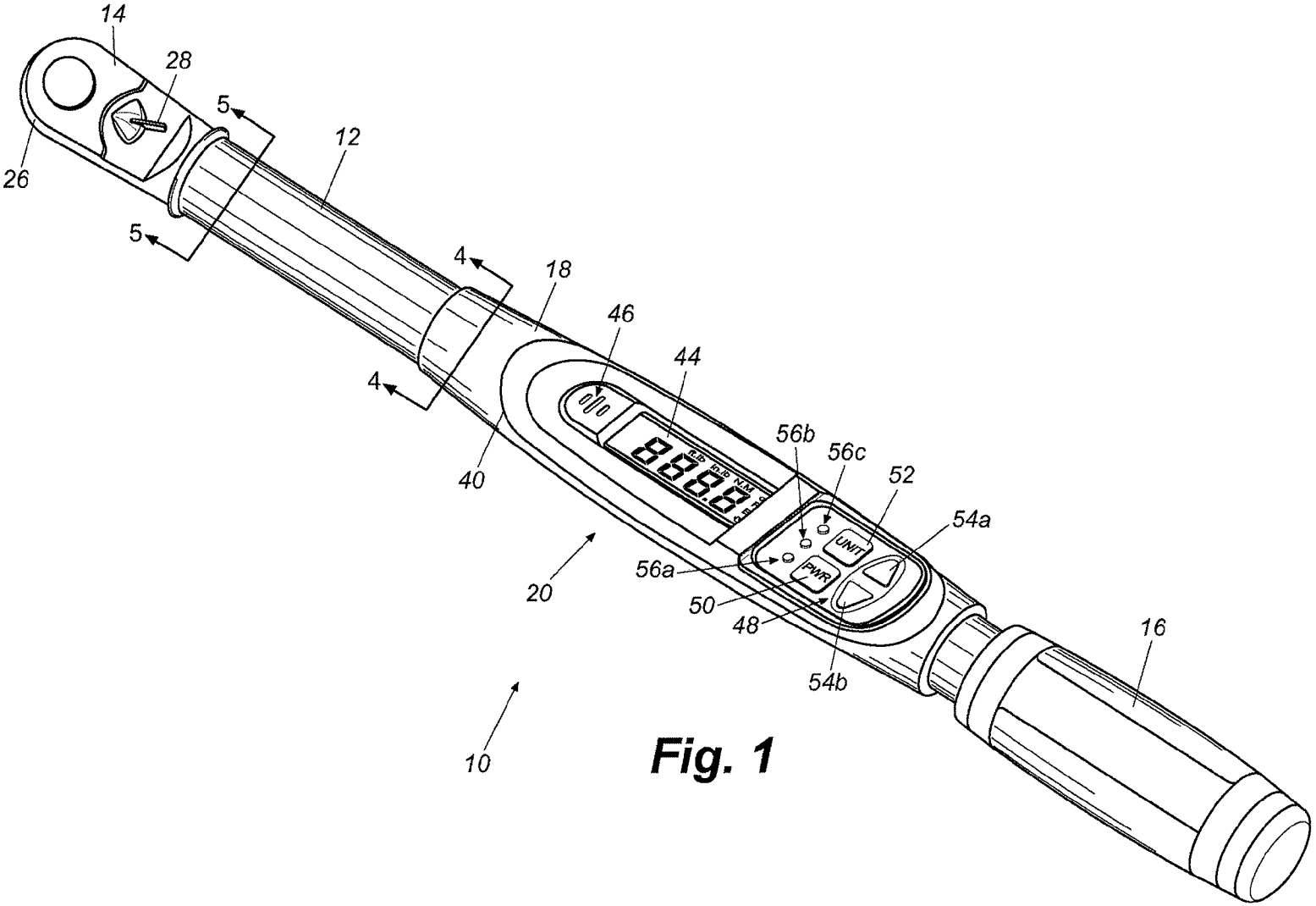
FIG. 1 is a perspective view of a preferred embodiment of an electronic torque wrench in accordance with the present invention.

Repeat use of reference characters in the present specification and drawings is intended to represent same or analogous features or elements of the invention according to the disclosure.

DETAILED DESCRIPTION OF THE PREFERRED EMBODIMENTS

Reference will now be made in detail to presently preferred embodiments of the invention, one or more examples of which are illustrated in the accompanying drawings. Each example is provided by way of explanation, not limitation, of the invention. In fact, it will be apparent to those skilled in the art that modifications and variations can be made in the present invention without departing from the scope and spirit thereof. For instance, features illustrated or described as part of one embodiment may be used on another embodiment to yield a still further embodiment. Thus, it is intended that the present invention covers such modifications and variations as come within the scope of the appended claims and their equivalents.

Figure 2:
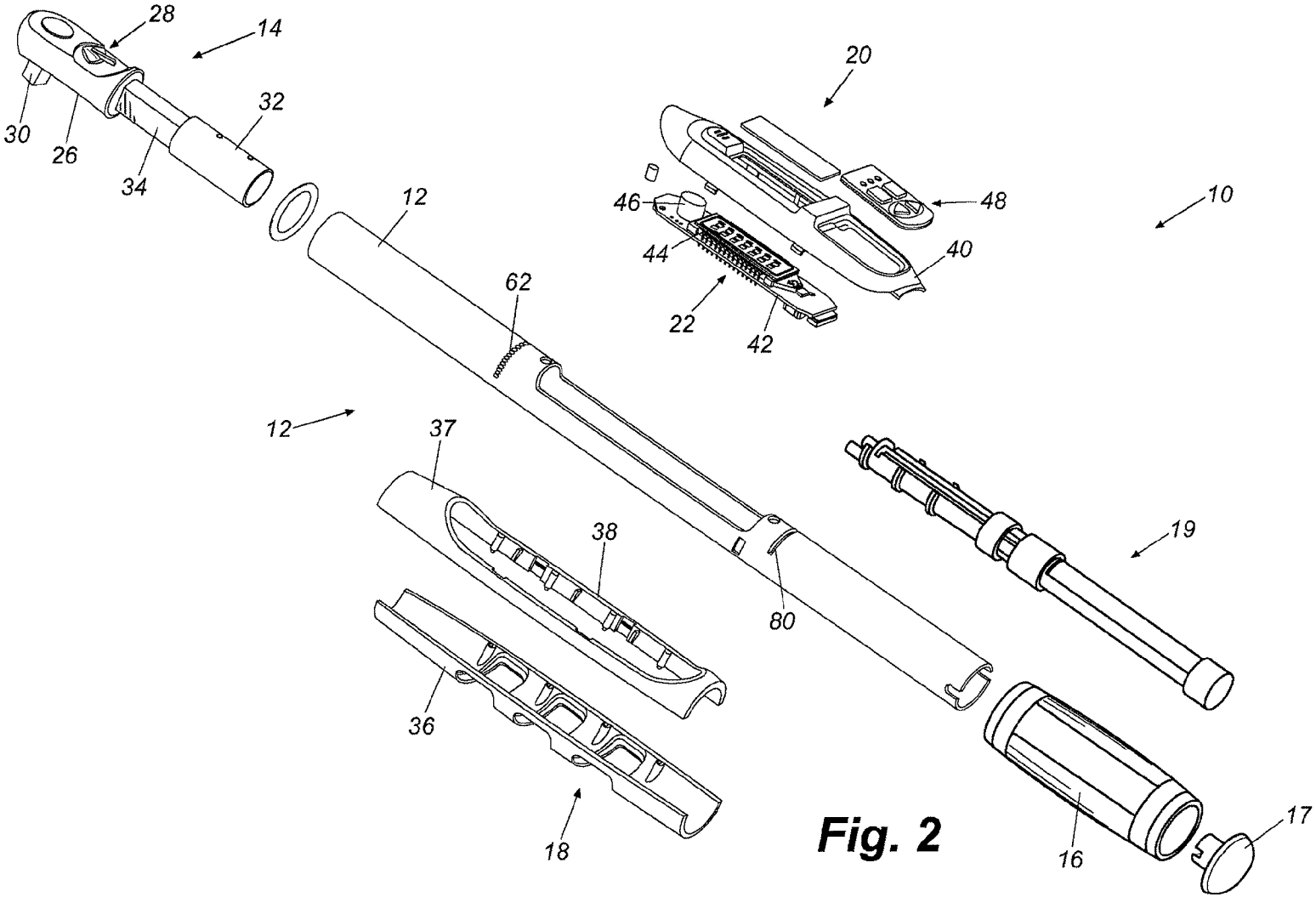
FIG. 2 is an exploded perspective view of the electronic torque wrench as shown in FIG. 1.

Referring now to FIGS. 1 and 2, an electronic torque wrench 10 including a rotary indexable display device 20 in accordance with the present invention is shown. The electronic torque wrench 10 includes a wrench body 12, a ratchet/wrench head 14, a grip handle 16, a housing 18, a battery assembly 19, and display device 20 with a user interface 22. Preferably, wrench body 12 is of tubular construction, made of steel or other rigid material, and receives wrench head 14 at a first end and battery assembly 19 at a second end, secured therein by an end cap 17. Housing 18 is mounted therebetween and carries display device 20.

As shown, a front end 26 of wrench head 14 includes a ratcheting mechanism with a lever 28 that allows a user to select whether torque is applied to a fastener in either a clockwise or counterclockwise direction. The ratcheting mechanism includes a boss 30 for receiving variously sized sockets, extensions, etc. (not shown). A rear end 32 of wrench head 14 is slidably received in wrench body 12 and rigidly secured therein. Wrench head 14 includes a flat portion 34 formed between front and rear ends 26 and 32 for receiving a strain gage assembly (now shown). In the preferred embodiment, the strain gage assembly is a full-bridge assembly including four separate strain gages on a single film that is secured to flat portion 34 of wrench head 14. An example of one such full-bridge strain gage assembly is Model No. N2A-S1449-1KB manufactured by Vishay Micromeasurement. Together, the full-bridge strain gage assembly mounted on the flat portion of wrench head 14 is referred to as a strain tensor.

Figure 3:
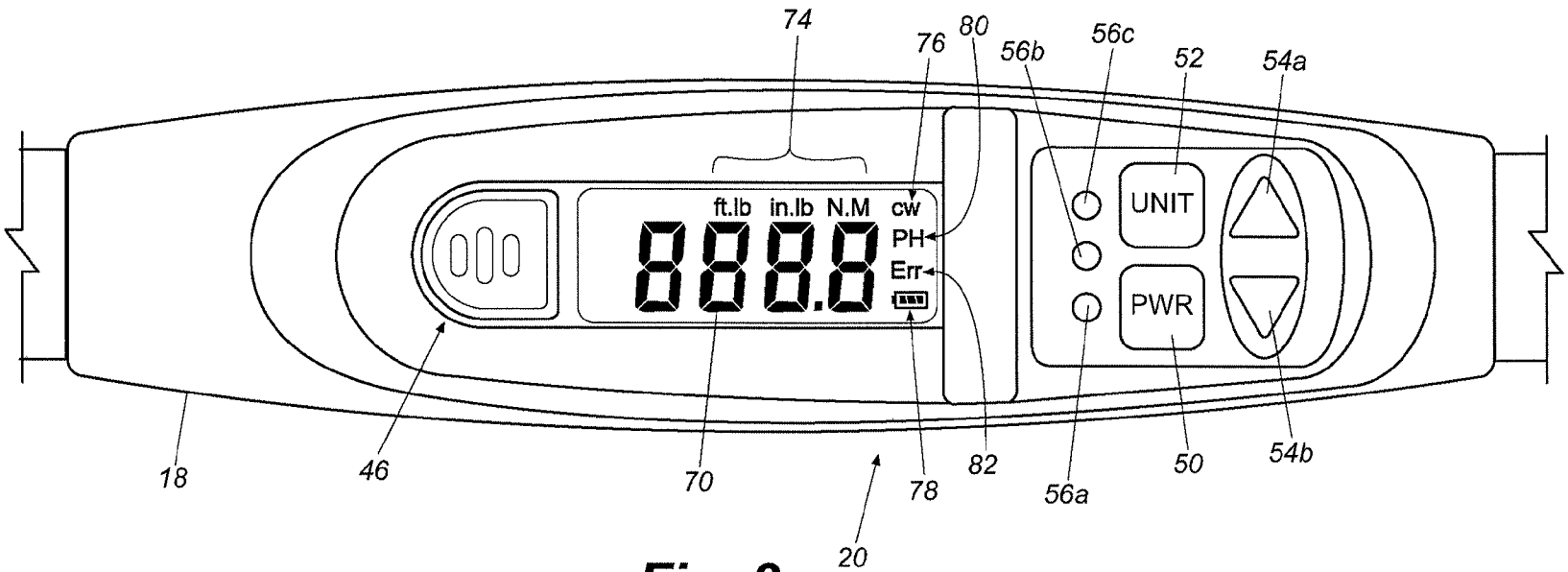
FIG. 3 is a top view of a display device of the electronic torque wrench as shown in FIG. 1.

Housing 18 includes a bottom portion 36 and a top portion 37 defining an aperture 38 for receiving display device 20. Display device 20 provides a user interface 22 for the operation of the electronic torque wrench. Display device 20 includes a printed circuit board 42 including a digital display 44 and an annunciator 46 mounted thereon. Printed circuit board 42 and a user input device 48 are secured to a housing cover 40 that is received in aperture 38 defined by top portion 37 of the housing. As best seen in FIG. 3, input device 48 includes a power button 50, a unit selection button 52, increment/decrement buttons 54*a* and 54*b*, and three light emitting diodes (LEDs) 56*a*, 56*b* and 56*c*. Light emitting diodes 56*a*, 56*b* and 56*c* are green, yellow and red, respectively, when activated.

FIG. 3 shows a detailed view of an embodiment of digital display 44 of the present invention. Preferably, digital display 44 is a liquid crystal display (LCD) including a current torque level indicator 70 (a four digit numeric display), an indication of units selected 74 (foot-pound, inch-pound, and Newton-meter), a torque direction indicator 76 (clockwise (CW) by default and counterclockwise (CCW) if selected), a battery level indicator 78, a peak hold indicator 80, and an error (Err) indicator 82.

Figure 4A:
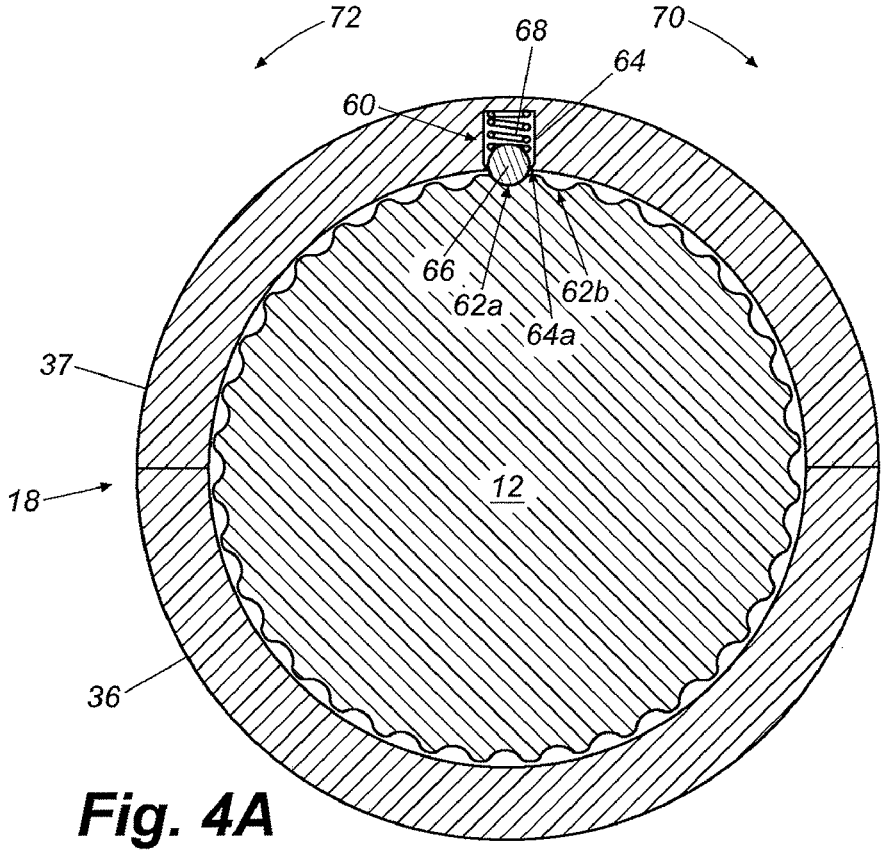
FIGS. 4A through 4C are cross-sectional views of the electronic torque wrench as shown in FIG. 1, taken along line 4-4.

As noted, display device 20 is rotatable with request to wrench head 14. Preferably, display device 20 is selectively rotatable, or indexable, between a discrete number of desired angular positions. As best seen in FIG. 4A, the indexing of display device 20 relative to wrench head 14 is provided by a spring-loaded detent 60 that is received in any one of a plurality of recesses 62. As shown, recesses 62 for receiving detent 60 are formed on an exterior surface of wrench body 12 and detent 60 is received in a bore 64 formed in top portion 37 of housing 18. Detent 60 includes a ball 66 that is urged outwardly by a spring 68. Ball 66 is retained in bore 64 by insuring that the front edge 64*a* of bore 64 has a diameter that is less than that of the ball.

As shown in FIG. 4A, the range of rotation of display device 20 with respect to wrench body 12 is 180 degrees in either a clockwise (arrow 70) or a counterclockwise (arrow 72) direction when viewing the wrench from the handle end. Recess 62*a* is symmetric about a plane that bisects wrench 10 into identical halves. As such, when detent 60 engages recess 62*a* display device 20 points directly upward when viewing the top of the wrench. To place display device 20 in a desired angular position relative to the top of wrench body 12, a user rotates housing 18 in the desired direction with a predetermined amount of rotational force. Upon application of the required force, ball 66 will be cammed inwardly against the outward biasing force of spring 68 until the ball rides over the ridge between adjacent recesses 62*a*, 62*b*. Ball 66 then engages adjacent recess 62*b* and will remain there unless the user continues to rotate housing 18. As shown, adjacent recesses 62 are offset in 10° increments (meaning there are 36 recesses 62), however, other increments (15°, 20°, etc.) are possible. The predetermined amount of force required to cause detent 60 to move from one recess to the next is affected by a number of factors, such as the shape of the recesses, shape of the detent, biasing force of the spring, etc., that can be varied as desired. Note, the electrical connection (not shown) between the display device 20 and the strain gage assembly (not shown) on flat portion 34 of wrench head 14 provides enough length to remain connected during the rotation of display device 20 relative to wrench body 12.

The total amount with which housing 18, and therefore display device 20, is rotatable with regard to wrench body 12 can be limited by a pin and slot configuration between the housing and the wrench body. As shown in FIG. 2, a slot 80 formed in wrench body 12 is engaged by a pin (not shown) extending inwardly from housing 18. As housing 18 is rotated about wrench body 12, the pin will eventually abut either end wall of slot 80, thereby preventing further rotation of housing 18. In this instance, it is only necessary to provide recesses 62 over that outer portion of the wrench body that detent 60 is rotatable over. As shown in FIGS. 1 and 2, grip handle 16 is rotatably fixed to wrench body 12. However, embodiments are envisioned wherein grip handle 16 is rotatably fixed to housing 18. As such, in those embodiments, display device 20 is rotatable by grasping and rotating grip handle 16 relative to the wrench body.

Figure 4B:
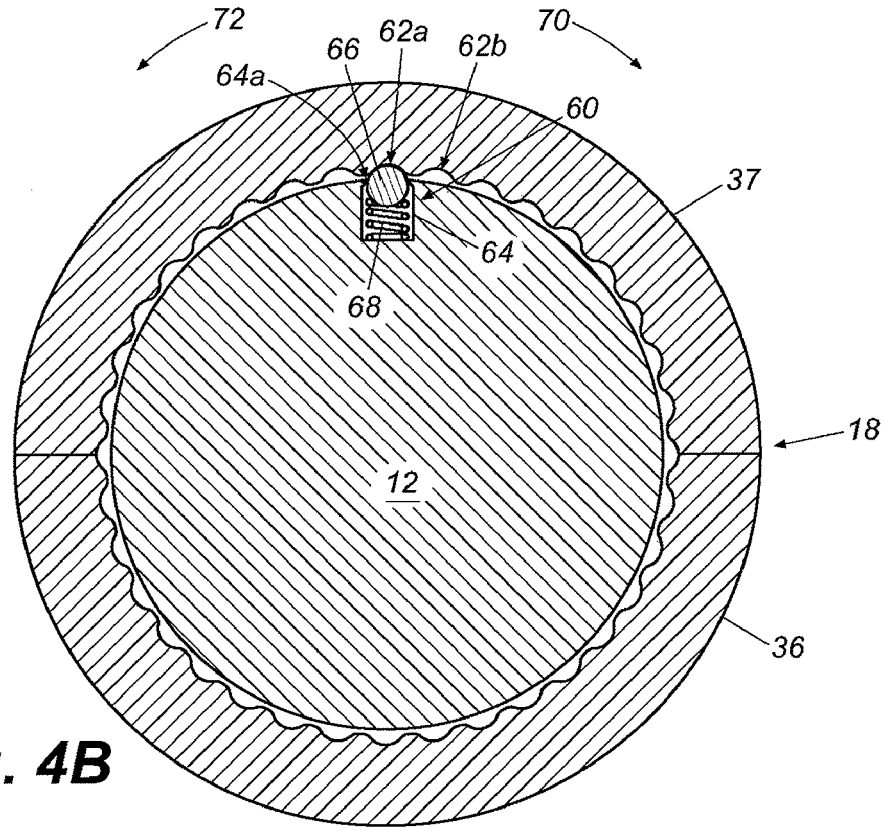
Figure 4C:
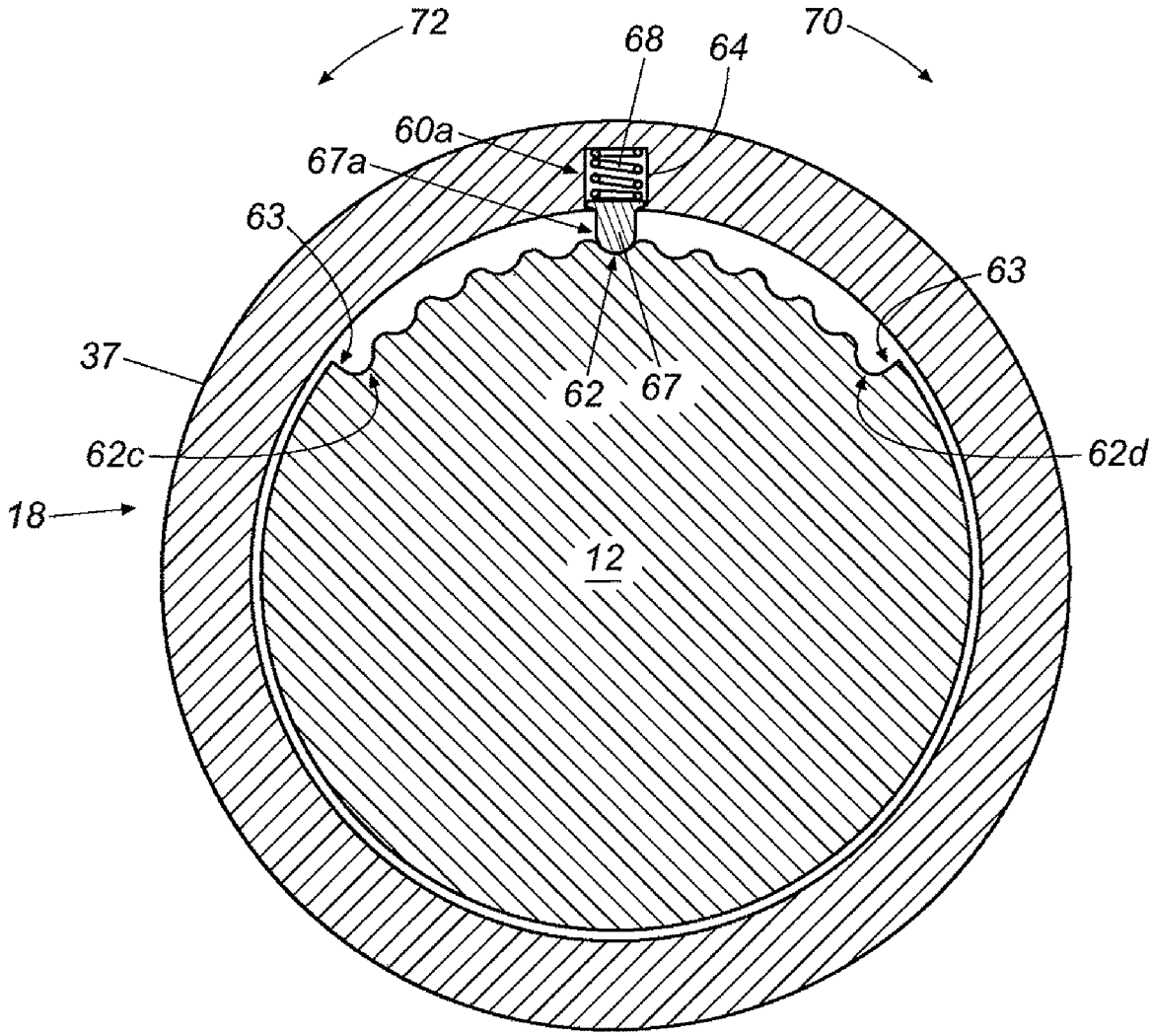

Referring now to FIG. 4C, an alternate embodiment includes a detent 60*a* including a plunger 67 that is biased outwardly from bore 64 by spring 68. Preferably, the portion of plunger 67 extending outwardly from bore 64 includes a substantially cylindrical sidewall 67*a*. As such, the end walls 63 of end recesses 62*c* and 62*d* can be configured to limit the rotation of housing 18 relative to wrench body 14. More specifically, endwalls 63 are extended outwardly toward the inner surface of housing 18 so that sidewall 67*a* will abut them rather than being cammed outwardly by them. As such, the engagement of plunger 67 with either end wall 63 prevents the rotation of plunger 67 beyond end recesses 62*c* and 62*d*.

Figure 5A:
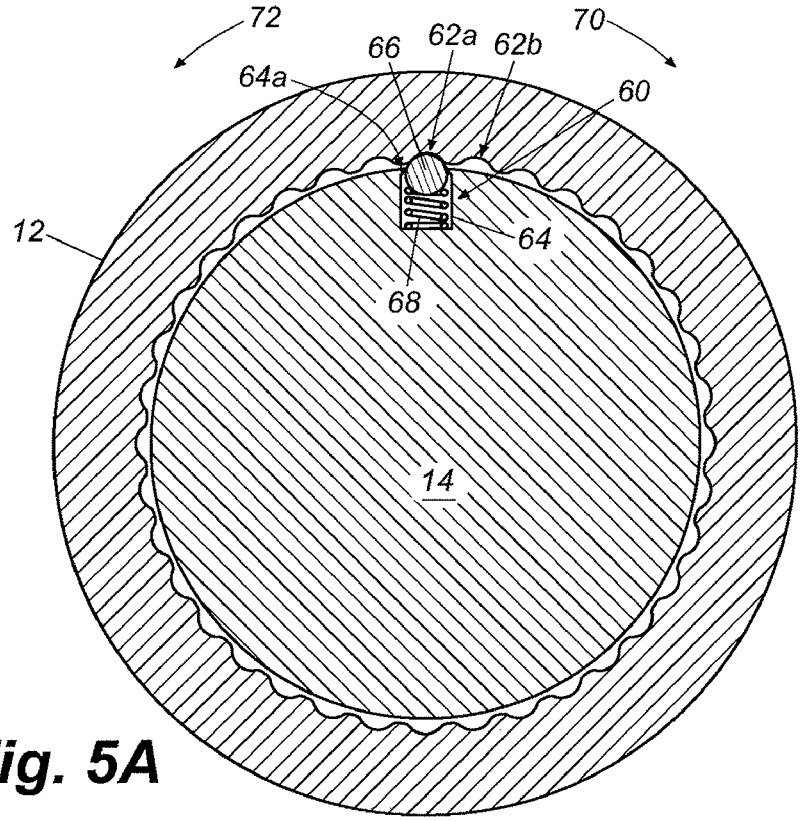
FIGS. 5A through 5C are cross-sectional views of the electronic torque wrench as shown in FIG. 1, taken along line 5-5.
Figure 5B:
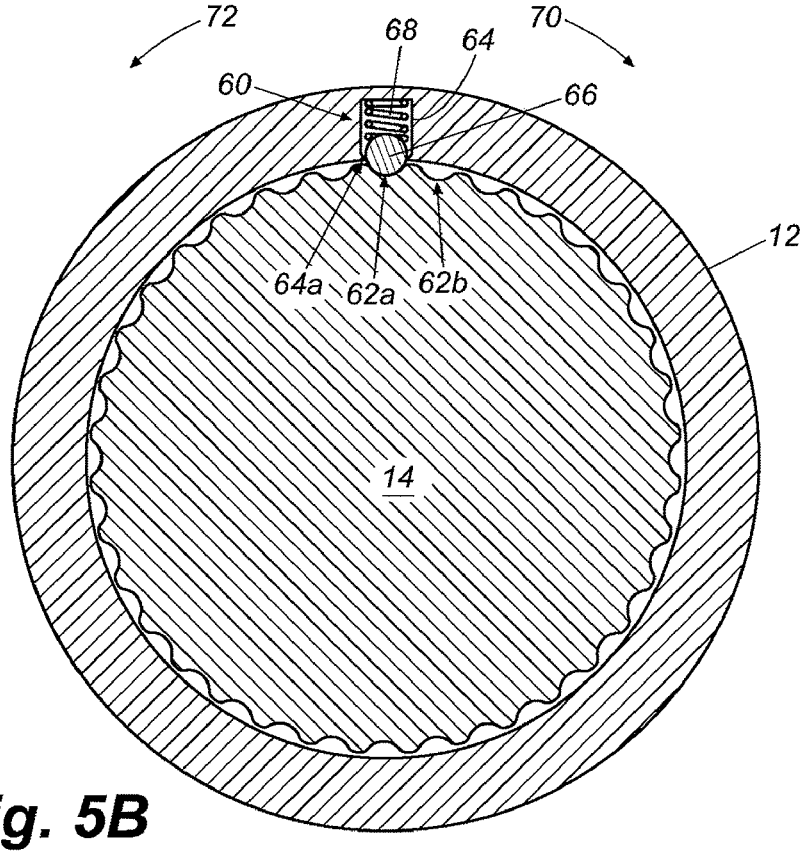
Figure 5C:
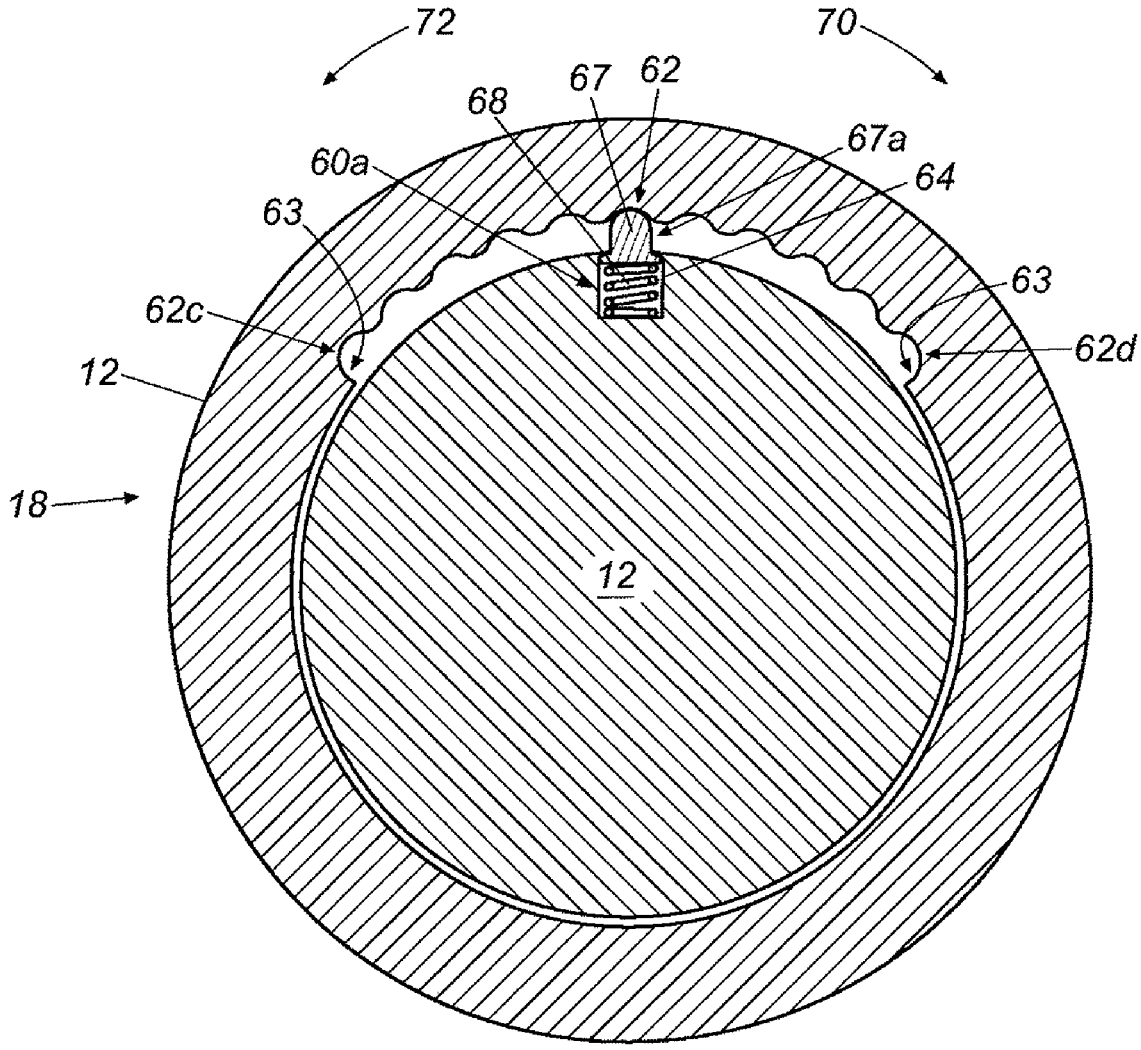

Referring now to FIGS. 5A and 5B, the housing, and therefore display device 20, is rotatably fixed to the wrench body, that is rotatable relative to wrench head 14. The embodiments as shown in FIGS. 5A and 5B function in a similar manner to those embodiments shown in FIGS. 4A and 4B, with the following exceptions. As shown in FIG. 5A, a plurality of recesses 62 is provided at 15° increments on an inner surface of wrench body 12 and a spring-loaded detent 60 is received in a bore 64 formed in the strain tensor end of wrench head 14. As shown in FIG. 5B, a plurality of recesses 62 is formed on the outer surface of the strain tensor and a spring-loaded detent 60 is received in a bore formed in wrench body 14. Similar to earlier discussed embodiments, a pin and slot configuration between wrench body 12 and wrench head 14 can be used to limit the amount of rotation between the two. Also, as shown in FIG. 5C, a plunger 67 style detent and recess combination can be utilized to limit the amount of rotation, as discussed above.

While applying torque to a fastener, green 56*a*, yellow 56*b*, and red 56*c* LEDs turn on or off depending on the peak torque value applied to the fastener up until that time. Preferably, green LED 56*a* comes on as long as the peak torque value is below 75% of the preset torque value and is switched off once the peak torque reaches 75% of the preset torque value. Yellow LED 56*b* comes on for peak torque values greater than 75% but less than 99% of the preset torque value. Red LED 56*c* comes on once the peak torque value reaches 99% of the preset torque value and stays on thereafter. The selection of percentage ranges for each color may be programmed, and the percentages at which the LEDs are switched on or off can be changed to suit the specific application. Embodiments are envisioned that include a liquid crystal display device that is capable of displaying multiple colors. This permits the warning LEDs to be replaced by appropriately colored symbols on the LCD.

Once the peak torque reaches the preset torque value, or is within a user selected range, a microcontroller generates electrical signals to generate an alarm sound on annunciator 46. A red color backlight (not shown) coincides with the audible alarm signal, indicating that the preset torque value has been reached. More colors, such as yellow and green, can be added as backlights to further assist the user when approaching the preset torque value. The user is also alerted if the mechanically safe torque value (elastic limit of the strain tensor) has been exceeded, possibly causing the torque wrench to lose proper calibration. This is determined by comparing the peak torque value to the elastic limit torque of the torque wrench. If the safe torque value is exceeded, an "Err" message is displayed on error indicator 82 and the unit stops, thus indicating that the electronic torque wrench unit needs calibration before it can be used again.

While one or more preferred embodiments of the invention are described above, it should be appreciated by those skilled in the art that various modifications and variations can be made in the present invention without departing from the scope and spirit thereof. It is intended that the present invention cover such modifications and variations as come within the scope and spirit of the appended claims and their equivalents.

What is claimed is:

1. A torque wrench for engaging a workpiece, comprising;
a wrench body having a first end and a second end;
a wrench head disposed on said first end of said wrench body, said wrench head being configured to engage the workpiece;
a display device carried by said wrench body, said display device including a housing, a display, and an input device for inputting a preset torque value;
a torque sensor carried by said wrench head;
an electrical connection between said torque sensor and said display device;
a detent extending outwardly from one of said wrench body, said wrench head, and said user interface; and
a plurality of recesses formed in another of said wrench body, said wrench head, and said user interface, each said recess being configured to releasably receive said detent;
wherein said display device is rotatable relative to said wrench head about a longitudinal center axis of said wrench body so that said detent is received by one of said recesses for retaining said display device in a desired angular position with regard to said wrench head.

2. The torque wrench of claim 1, wherein:
said detent extends outwardly from said wrench body; and
said plurality of recesses are formed in an inner cylindrical surface of said display device;
wherein said display device is rotatable about said wrench body.

3. The torque wrench of claim 2, wherein said inner cylindrical surface is a portion of said housing of said display device.

4. The torque wrench of claim 3, wherein movement of said detent from a first recess to an adjacent said recess requires application of a predetermined torque to said display device about said wrench body.

5. The torque wrench of claim 3, wherein said wrench head further comprises a ratcheting drive head that is rotatably fixed to said wrench body.

6. The torque wrench of claim 1, wherein:
said detent extends inwardly from an inner cylindrical surface of said display device; and
said plurality of recesses is formed in an outer cylindrical surface of said wrench body;
wherein said display device is rotatable about said wrench body.

7. The torque wrench of claim 6, wherein said inner cylindrical surface is a portion of said display device housing.

8. The torque wrench of claim 7, wherein said wrench head further comprises a ratcheting drive head that is rotatably fixed to said wrench body.

9. The torque wrench of claim 1, wherein:
said detent extends inwardly from said wrench body; and
said plurality of recesses are formed in an outer cylindrical surface of said wrench head;
wherein said wrench body is rotatable about said wrench head.

10. The torque wrench of claim 1, wherein:
said detent extends outwardly from said wrench head; and
said plurality of recesses are formed in an inner cylindrical surface of said wrench body;
wherein said wrench body is rotatable about said wrench head.

11. The torque wrench of claim 10, wherein said wrench head further comprises a ratcheting drive head.

12. The torque wrench of claim 1, wherein said torque sensor further comprises at least one strain gage.

13. The torque wrench of claim 1, further comprising a grip handle disposed on said second end of said wrench body.

14. The torque wrench of claim 1, wherein said display further comprises a digital display.

15. The torque wrench of claim 1, further comprising an annunciator disposed on said display device.

* * * * *